US006193128B1

(12) United States Patent
Salice

(10) Patent No.: US 6,193,128 B1
(45) Date of Patent: Feb. 27, 2001

(54) DRIVING-IN TOOL WITH A ROTATABLE LEVER

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 09/320,610

(22) Filed: May 26, 1999

(30) Foreign Application Priority Data

May 26, 1998 (DE) ..... 298 09 461 U

(51) Int. Cl.[7] ..... B52C 5/02; B52C 7/00

(52) U.S. Cl. ..... 227/134; 227/119; 227/139; 227/149

(58) Field of Search ..... 227/134, 147, 227/149, 139, 9, 11, 119; 144/92; 81/44

(56) References Cited

U.S. PATENT DOCUMENTS

| | | | | |
|---|---|---|---|---|
| 2,743,444 | * | 5/1956 | Thomas | 81/44 |
| 3,040,328 | * | 6/1962 | Saltz | 227/149 |
| 3,563,441 | * | 2/1971 | Christensen | 227/147 |
| 3,623,647 | * | 11/1971 | Steinberg | 227/149 |
| 3,638,892 | * | 2/1972 | Boye et al. | 227/9 |
| 3,695,086 | * | 10/1972 | Savage | 227/149 |
| 3,998,372 | * | 12/1976 | Leonardo et al. | 227/149 |
| 4,136,275 | * | 1/1979 | McCullough | 227/149 |
| 4,614,012 | * | 9/1986 | Blum | 144/92 |
| 4,692,973 | * | 9/1987 | Blum | 144/92 |
| 4,705,201 | * | 11/1987 | Bennett | 227/149 |
| 4,706,868 | * | 11/1987 | Hammerle et al. | 227/149 |
| 5,400,501 | * | 3/1995 | Marshall | 227/129 |

FOREIGN PATENT DOCUMENTS

| | | |
|---|---|---|
| 3508521 | 10/1985 | (DE) . |
| 4315639 | 12/1993 | (DE) . |
| 29511216 | 9/1995 | (DE) . |
| 4445736 | 6/1996 | (DE) . |
| 19527600 | 1/1997 | (DE) . |

* cited by examiner

*Primary Examiner*—Peter Vo
*Assistant Examiner*—Jim Calve
(74) *Attorney, Agent, or Firm*—Dilworth & Barrese

(57) ABSTRACT

A driving-in tool for a furniture part which can be fitted in place by at least one rotating lever, is provided in which the driving-in tool possesses a centering part shaped in accordance with the fitting part to be connected and serving as an insertion guide, and a spring or spring-loaded holding part supporting the rotating lever in its open position.

16 Claims, 2 Drawing Sheets

DRIVING-IN TOOL WITH A ROTATABLE LEVER

BACKGROUND OF THE INVENTION

The invention relates to a driving-in tool for the correct mounting of furniture fittings provided with a rotatable lever.

Driving-in tools for the insertion of furniture fittings can be used with mounting devices of drills which simultaneously serve to press in mounting plates or cup-shaped hinge parts into the cut mounting and dowel holes. Such a drill and mounting device is known from DE 35 08 521 A. On the other hand, driving-in tools are already known for the manual mounting of furniture fittings. For example, connection fittings made of plastic can be sunk through furniture fittings into pre-drilled mounting holes by press fit. Here, the driving-in tools are suitable to distribute the press force in the correct manner without any damage to the furniture fittings.

A fitting element for fittings is known, for example, from DE 295 11 216 which can only be locked in place in a pre-drilled borehole of an assembly part by throwing or pressing down a lever. Here, the fitting element consists of a conical, essentially cylindrical section which is provided with a radial breakthrough in which two spreaders are guided for travelling out in opposite directions over the cylindrical jacket contour and for being pulled back in its region and of a link or slide whose one end can have pressure applied to it by an actuating lever for its motion and whose other end is fitted to a bolt guided in axial slits of the cylindrical section, which bolt penetrates slots of the spreaders positioned in such a way that said spreaders are travelled in and out by a rotation of the link or lever. While such fitting elements allow the mounting of prefabricated furniture parts without any special tools such as screwdrivers or similar, they can, however, be actuated unintentionally by accident prior to the final pressing in of the fitting as the rotating lever is supported near the surface on the fitting and is generally rotatable in the same direction of pressing in. This has the consequence that the fittings can be unintentionally fitted in an incorrect position.

SUMMARY OF THE INVENTION

It is the object of the invention to provide a driving-in tool for furniture fittings provided with at least one rotating lever, which driving-in tool simplifies the easy and correct mounting of the furniture fittings in the pre-drilled boreholes of the furniture parts.

In accordance with the invention, this object is solved by a driving-in tool in accordance with the a driving-in tool for a furniture fitting part which can be fitted in place by at least one rotating lever, by combination with the the driving-in tool possessing a centering part shaped in accordance with the fitting part to be connected and serving as an insertion guide and a spring or spring-loaded holding part supporting the lever in its open position. Accordingly, the driving-in tool possesses a centering part shaped to correspond to the connecting fitting and serving as an insertion guide and a spring or spring-loaded part supporting the rotating lever in its open position.

The furniture fitting remains in a fixed, pre-mounted position on the driving-in tool during the mounting, with the actuating lever of the furniture fitting being turned in its open position and being supported in this by the holding part of the driving-in tool. The furniture fitting is not directly actuated during mounting so that any unintentional throwing of the actuating lever is excluded. Only when the fitting part has been put into its completely inserted mounting position and has been fixed in this position by the lever now having been intentionally thrown by overcoming the spring force of the holding part can the driving-in tool again be removed from the fitting part. The correct mounting position is thus ensured.

Preferred aspects of the invention can be seen from the further description herein.

The invention can advantageously be further developed by providing on the driving-in tool another actuating lever which acts on the actuating lever of the furniture fitting part and which enlarges the latter's lever arm and thus reduces the force to be exerted. When inserting the fitting parts provided with the actuating levers into the furniture parts, no pressing force is required so that manual mounting can generally be performed without any great force. When locking the fitting parts in position in the associated boreholes, however, force must be exerted to throw the at least one actuating lever which force can lead to finger fatigue, particularly in the event of extensive mounting work. Here, a remedy is created thanks to the aspect of the invention described above by which the force application to throw the actuating lever for the furniture fitting is reduced.

BRIEF DESCRIPTION OF THE DRAWINGS

Further details and advantages of the invention can be found in the embodiments of the present invention shown in the drawing, in which.

DESCRIPTION OF THE PREFERRED EMBODIMENTS

Figure 1:
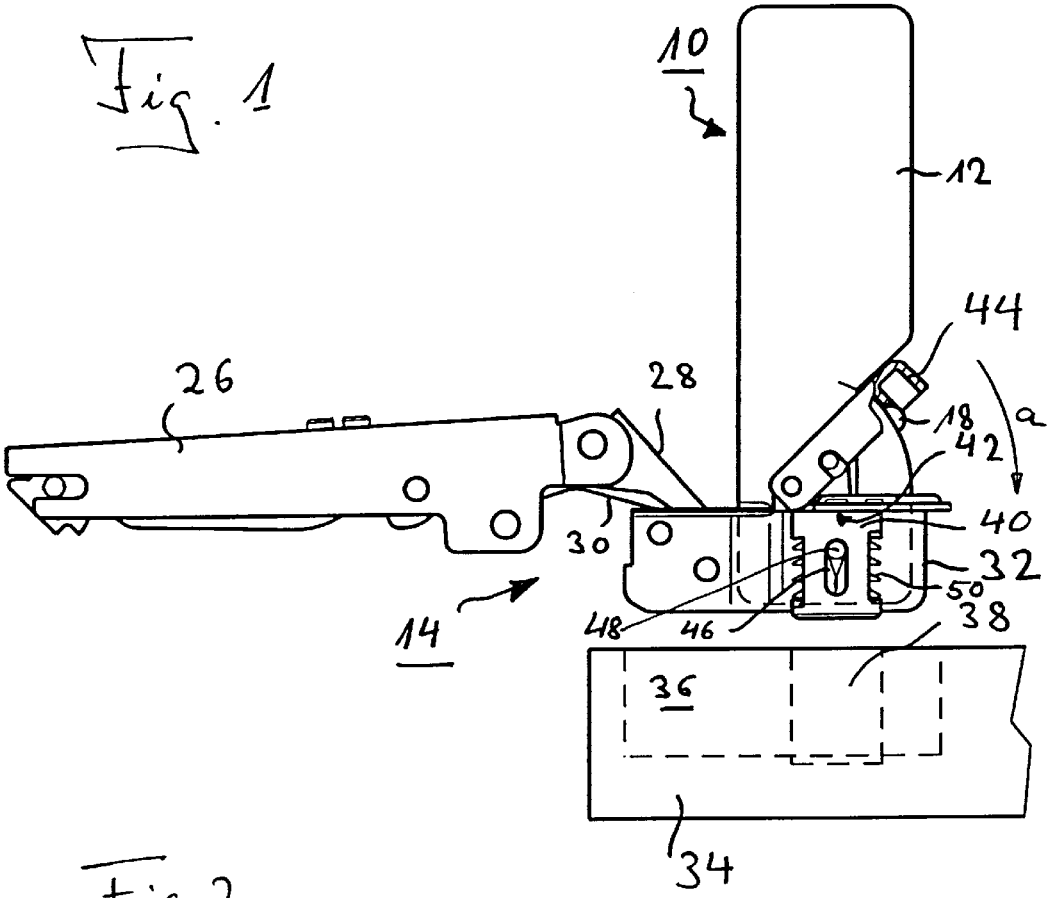
FIGS. 1 to 3 show different representations of a first embodiment of the driving-in tool in accordance with the invention.
Figure 2:
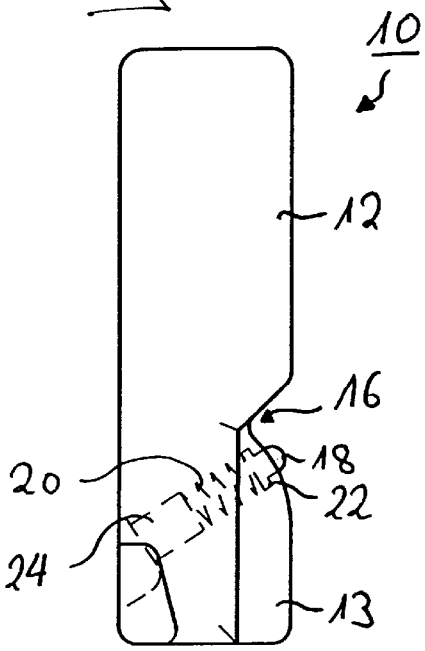
Figure 3:
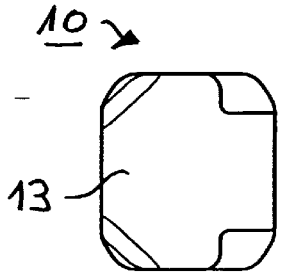

FIG. 2 shows the first embodiment of a driving-in tool 10, which possesses an actuating part or a handle 12 and a lower centering part 13. The centering part 13 is shaped in accordance with the recess of the furniture fitting part 14 to be inserted (FIG. 1). From the bottom view of the driving-in tool 10 shown in FIG. 3, the form of the centering part 13 can be seen. The driving-in tool 10 has overall essentially a cuboid basic shape and consists preferably of plastic. In a recess 16 following on from the centering part 13 there protrudes a rounded end of a journal 18 which is pressed by means of a spring 20 against a flange-shaped stop 22 beneath the rounded end of the journal 18. The spring 20 is supported in a slanted recess or borehole in the region of the centering part 13, said recess or borehole being closed by a threaded pin 24.

In FIG. 1, the driving-in tool 10 is inserted in a corresponding fitting part 14. The fitting part 14 has a design as already described in DE 295 11 216 U. It possesses a hinge arm 26 which is hinged to a hinge cup 32 by means of two links 28 and 30. The hinge arm 26 is of a known type and is therefore not described in detail.

The hinge cup 32 can be provided in a conventional way on a furniture door 34 with a flat, blind borehole 36 for the mounting of the hinge cup 32 and to the side of said borehole with two pre-drilled blind holes 38. In these pre-drilled blind holes 38, two dowel-like cylindrical sections 40 are inserted which are fitted to the flange-shaped edges 42 of the hinge cup 32. The dowel-like cylindrical sections 40 are locked in place in the pre-drilled blind holes 38 only be pressing down an actuating lever 44. By means of the actuating lever 44, a bolt 48 guided in axial slots 46 is fixed in place which applies pressure to two spreaders 50 which can be moveed out over the cylindrical section 40 in such a way that they can be moved in and out by rotating the actuating lever.

Specifically, with regard to this design of the fitting elements reference can be made to DE 295 11 216 U. In FIG. 1, the driving-in tool 10 is shown in a position inserted into the fitting part 14. The connection of the driving-in tool 10 to the fitting part 14 is effected by the actuating lever 44 being rotated into its open position in which it is supported, as shown in FIG. 1, by the rounded end of the journal 18. In this position, the cup 32 can be inserted into the furniture door 34 by means of the handle 12. After inserting the hinge cup 32 into its end position, the actuating lever 44 can be rotated downwards in the direction of the arrow a against the resistance of the rounded end of the journal 18, i.e. against the spring force 20. In this way, it is ensured that the rotating lever 44 is only actuated after the complete pressing in of the fitting part 14. After the mounting of the furniture fitting part 14 in the furniture door 34, the driving-in tool 10 can again be separated from the fitting part 14.

Figure 4:
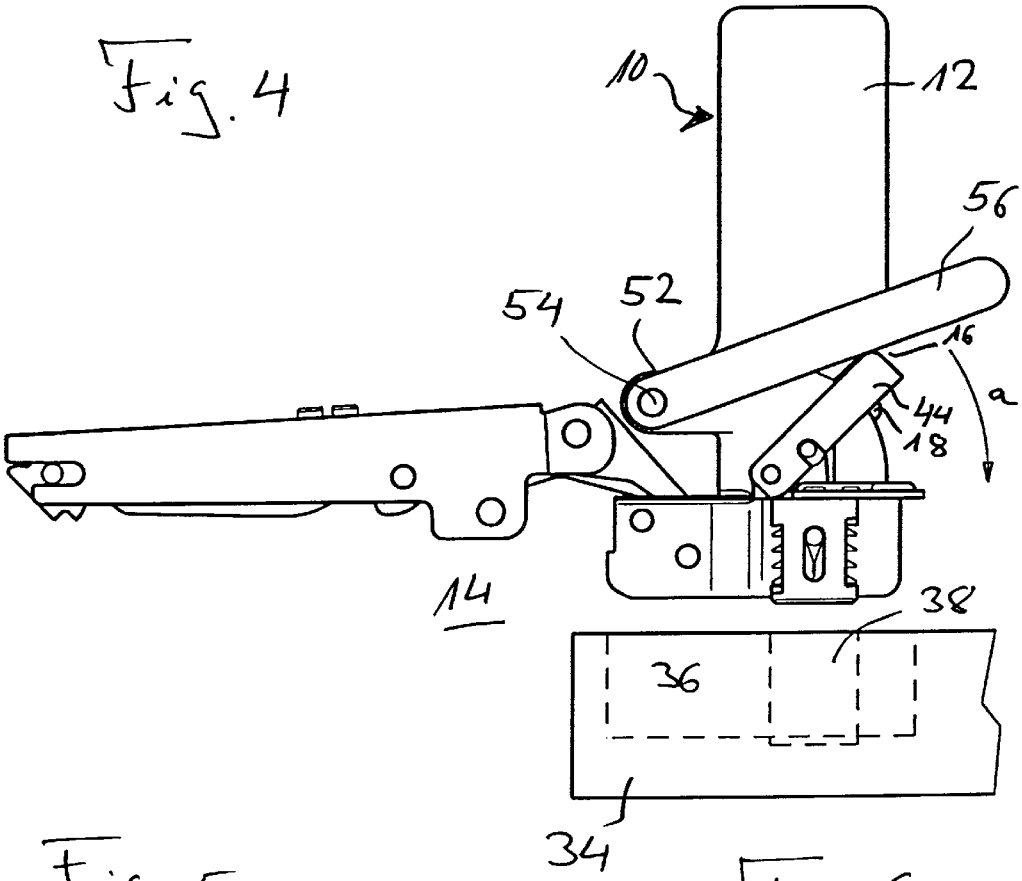
FIGS. 4 to 6 show a second embodiment of the driving-in tool in accordance with the invention in different views.
Figure 5:
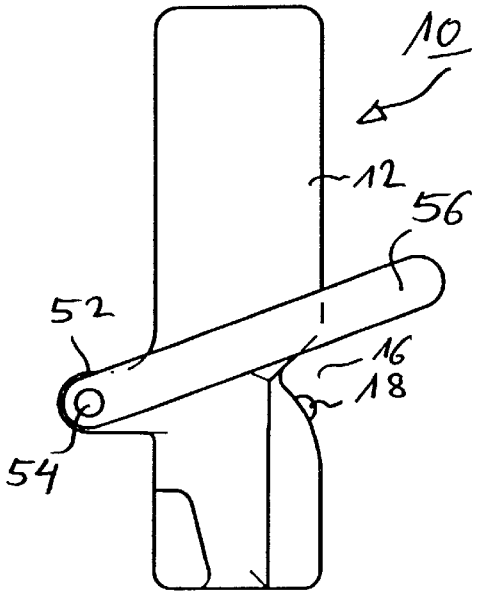
Figure 6:
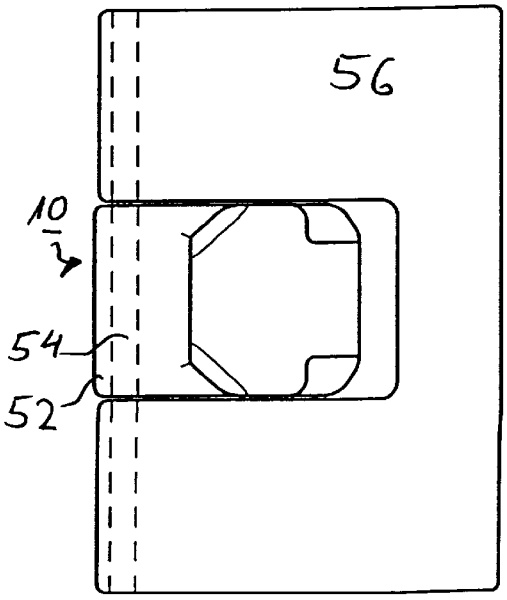

In FIGS. 4 to 6, another embodiment of the invention is shown where the driving-in tool 10 possesses on the side opposite the recess 16 a protrusion 52 at whose free end an actuating lever 56 is pivoted around a bolt 54. The actuating lever 56 is, as can be seen particularly in detail in FIG. 4, positioned in such a way that in the mounted state of the driving-in tool 10 it can interact with the actuating lever 44 of the fitting part 14. Due to the comparatively longer lever arm of the actuating lever 56, the actuating lever 44 can be rotated by means of a lower force in the direction of the arrow a against the force of the spring-biased rounded end of the journal 18.

What is claimed is:

1. A driving-in tool for a furniture fitting part fitted in place by at least one rotating lever, the driving-in tool comprising a means for centering shaped to fit in a recess in the fitting part to be connected and serving as an insertion guide and a spring-loaded holding part structured and arranged to support the rotating lever in its open position.

2. A driving-in tool in accordance with claim 1, additionally comprising, on the driving-in tool, an additional actuating lever arranged to interact with the rotating lever of the fitting part when actuated.

3. A driving-in tool in accordance with claim 2, additionally comprising a laterally extending protrusion on which one end of the actuating lever is pivoted.

4. A driving-in tool in accordance with claim 1, structured and arranged such that, upon complete insertion of the fitting part into mounting position, the rotating lever is pivoted against resistance of force of the spring-loaded holding part.

5. A driving-in tool in accordance with claim 2, wherein said additional actuating lever is arranged to contact the rotating lever of the fitting part, to reduce force required to pivot the rotating lever of the fitting against resistance of the spring-loaded part.

6. A driving-in tool in accordance with claim 1, wherein said centering part comprises a spring;

said spring-loaded part being constituted by a journal having a rounded end; and a recess positioned in said centering means and from which said rounded end of said journal protrudes as pressed by said spring.

7. A driving-in tool in accordance with claim 4, wherein said centering part comprises said spring;

said spring-loaded part being constituted by a journal having a rounded end; and a recess positioned in said centering means and from which said rounded end of said journal protrudes as pressed by said spring.

8. A driving-in tool in accordance with claim 6 additionally comprising a slanted borehole with respect to an axis of said centering part and in which said spring is supported, a flange-shaped stop positioned at an end of said borehole adjacent said rounded end of said journal, and a threaded pin closing an opposite end of said borehole.

9. A driving-in tool in accordance with claim 6, additionally comprising, on the driving-in tool, an additional actuating lever arranged to contact the rotating lever of the fitting part when actuated, a laterally extending protrusion on which one end of the actuating lever is pivoted, and wherein said protrusion is positioned on a side of said centering part opposite said recess.

10. A driving-in tool in accordance with claim 1, wherein said tool comprises an overall essentially cuboid basic shape.

11. A driving-in tool in accordance with claim 1, being composed of plastic.

12. The combination of a furniture-fitting part fitted in place by at least one rotating lever and a driving-in tool, said driving-in tool comprising a centering part at one end of the driving-in tool, said centering part being shaped to fit in a recess in the fitting part to be connected and serving as an insertion guide, and a spring-loaded holding part structured and arranged to support the rotating lever of the fitting parts in its open position.

13. The combination of claim 12, structured and arranged such that, upon complete insertion of the fitting part into mounting position, the rotating lever is pivoted against resistance of force of the spring-loaded holding part.

14. The combination of claim 13, wherein said centering part comprises said spring;

said spring-loaded part being constituted by a journal having a rounded end; and a recess positioned in said centering part and from which said rounded end of said journal protrudes as pressed by said spring.

15. The combination of claim 14, additionally comprising a slanted borehole with respect to an axis of said centering part and in which said spring is supported, a flange-shaped stop positioned at an end of said borehole adjacent said rounded end of said journal, and a threaded pin closing an opposite end of said borehole.

16. The combination of claim 14, wherein said fitting part comprises a hinge arm, a hinge cup, two links arranged to couple said hinge arm to said hinge cup in pivotal fashion, said hinge cup comprising flange-shaped edges, two dowel-like cylindrical sections structured and arranged to be fitted to said flange-shaped edges of said hinge cup, axial slots respectively provided in said dowel-like cylindrical sections, bolts provided on respective sides of said hinge cup and arranged to extend into said axial slots in said dowel-like cylindrical sections, and two spreaders arranged to receive pressure from said bolts as the same are guided along said respective axial slots, such that said spreaders can be extended and retracted by rotating the rotating lever of said fitting part.

* * * * *